United States Patent [19]

Slikas et al.

[11] 4,343,438

[45] Aug. 10, 1982

[54] RING HAMMER

[75] Inventors: Anthony W. Slikas, Birmingham, Ala.; Joseph P. Nigro, Villanova, Pa.

[73] Assignee: Pennsylvania Crusher Corporation, Broomall, Pa.

[21] Appl. No.: 136,216

[22] Filed: Apr. 1, 1980

[51] Int. Cl.[3] ..... B02C 13/28

[52] U.S. Cl. ..... 241/196

[58] Field of Search ..... 241/193, 195, 196

[56] References Cited

U.S. PATENT DOCUMENTS

| | | | |
|---|---|---|---|
| 1,733,637 | 10/1929 | Williams et al. | 241/196 |
| 2,666,589 | 1/1954 | Danyluke | 241/193 X |
| 3,356,016 | 12/1967 | Eidal | 241/193 X |
| 3,580,518 | 5/1971 | Strom | 241/193 |
| 3,591,096 | 7/1971 | De Feo | 241/193 X |
| 4,149,677 | 4/1979 | Graveman et al. | 241/196 X |

*Primary Examiner*—Howard N. Goldberg
*Attorney, Agent, or Firm*—Pollock, Vande Sande & Priddy

[57] ABSTRACT

A ring hammer (10) is disclosed for use in material reduction apparatus such as a coal granulator, the ring hammer including a substantially circular body (12) having a plurality of circumferentially spaced radially projecting teeth (22) joined by a corresponding plurality of connecting segments (30). The teeth and connecting segments taper inwardly (26, 32) from their outermost surfaces (24, 34) toward the axial ends (28) of the hammer, the taper of the connecting segments being significantly larger than that of the teeth. This geometry facilitates manufacture of the hammer by forging and insures the presence of tooth-like projections on the hammer even when the outer surfaces of the teeth have worn down to the level of the connecting segments.

12 Claims, 2 Drawing Figures

RING HAMMER

TECHNICAL FIELD

The present invention relates in general to machines for reducing various materials and more particularly to ring-type hammers for use in such machines.

BACKGROUND ART

Material reducing machines for pulverizing, crushing and shredding various materials have been known for many years. In a particular type of such machine, a rotor is provided with loosely fitted ring hammers which tend to rotate with respect to the rotor itself upon impact with the material to be reduced. As a result of this movement, the wear on the hammer is distributed rather evenly over the cutting edges of the hammer as they sweep past the grate bars of the machine. The ring hammers tend to withdraw into the rotor upon encountering over-sized or extremely tough material, thereby avoiding some types of hammer failures which would occur if the hammers were mounted differently. U.S. Pat. Nos. 2,666,589 issued to Danyluke and 3,591,096 issued to DeFeo, both assigned to the assignee of the present application, disclose examples of prior art crushing machines embodying ring hammers. Another example is shown in U.S. Pat. No. 3,580,518 issued to Strom.

In prior art crushing machines of which the applicants are aware, the ring hammers have typically been cast from a type of manganese steel having good work-hardening characteristics. However, it has been found that cast ring hammers made from this material wear much more quickly than would be expected in some applications. More particularly, when the material being reduced is relatively soft, such as would be the case in coal granulators, the impact forces generated on the hammer surfaces apparently are insufficient to cause significant work hardening so that accelerated hammer wear is experienced. In addition, it has been observed over a number of years that cast hammers made from this and other materials are frequently rather difficult to balance as required prior to use so that excessive machine vibration is experienced. Finally, it has been observed that prior art ring hammers tend to wear in such a way that the hammer eventually achieves an almost smooth outer surface lacking any tooth-like protrusions which are desirable for effective crushing action. Without such tooth-like protrusions, the worn ring hammer has difficulty biting into the material and may actually fail to rotate with respect to the rotor, leading to uneven wear distribution around the circumference of the hammer.

DISCLOSURE OF THE INVENTION

Applicants have discovered that by suitably configuring the geometry of the ring hammer teeth, several problems with prior art hammer designs can be substantially eliminated. Particularly, it has been found that tooth-like projections on the hammer can be retained as the hammer wears provided that the outer surfaces of the teeth taper toward the ends of the hammer at an angle which is less than the angle of taper of the connecting segments between teeth. Although hammers having this unique geometry may be cast as in the past, this new geometry also permits manufacturing the hammer by forging techniques. This is possible since the tapered tooth geometry permits the hammer to be readily withdrawn from the forging dies, as was not possible with prior art ring hammer designs which did not include such tapers. The modest degree of work hardening of the hammer surfaces during the forging process and additional hardening resulting from subsequent heat treating ensure that the surface hardness of the forged hammers is sufficient to withstand normal wear without the need for any additional work hardening during use.

In one preferred embodiment of the invention, the ring hammer comprises a substantially circular body having a central bore with an axis, an axial length and a radial thickness. A plurality of teeth project radially outwardly from the circular body, each tooth having at least one contact surface which extends partially circumferentially around the circular body, at least at the radially outermost portion of the tooth. The contact surface is substantially parallel to the axis of the body and each tooth tapers radially inwardly from the contact surface toward the axial ends of the hammer. Preferably, the contact surface is substantially cylindrical in configuration and centered on the axial length of the ring. Between teeth, a plurality of connecting segments are provided which extend circumferentially between and interconnect adjacent teeth, each of the connecting segments tapering radially inwardly toward the axial ends of the hammer at an angle greater than the angle at which the teeth taper from their contact surface.

The teeth may be formed symmetrically about a radius extending from the axis of the ring, which permits installing the hammers in either orientation and facilitates reversing the hammers in use as wear progresses on one side of the symmetrical teeth. The connecting segments also may be provided with further contact surfaces at their radially outermost portion, these further contact surfaces extending partially around the circular body and being substantially parallel to its axis. The teeth include axially extending flanks onto which their contact surfaces may extend so that the contact surfaces of the teeth merge with the further contact surfaces provided on the connecting segments. As in the case of the contact surfaces on the teeth, the further contact surfaces of the connecting segments preferably are substantially cylindrical in configuration, parallel to the axis of the ring and centered on its axial length. To provide a maximum contact surface on the tooth, the taper of the tooth preferably is greater than zero and less than five degrees; whereas, the taper of the connecting segments is greater than the taper of the teeth but less than approximately twenty degrees.

BEST MODE FOR CARRYING OUT THE INVENTION

Figure 2:
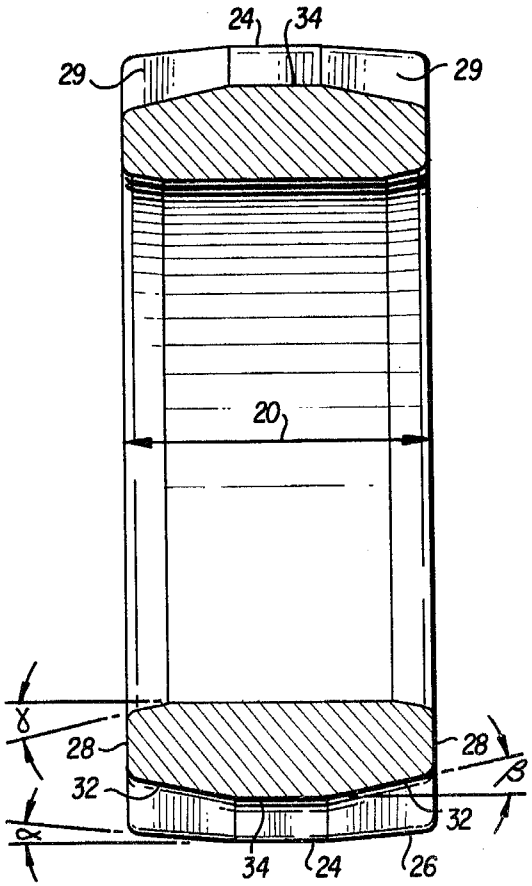
FIG. 2 shows a section view taken along line 2—2 of FIG. 1.

The following is a detailed description of a ring hammer embodying the present invention, reference being made to the drawing in which like reference numerals identify like elements of structure in each of the figures.

Figure 1:
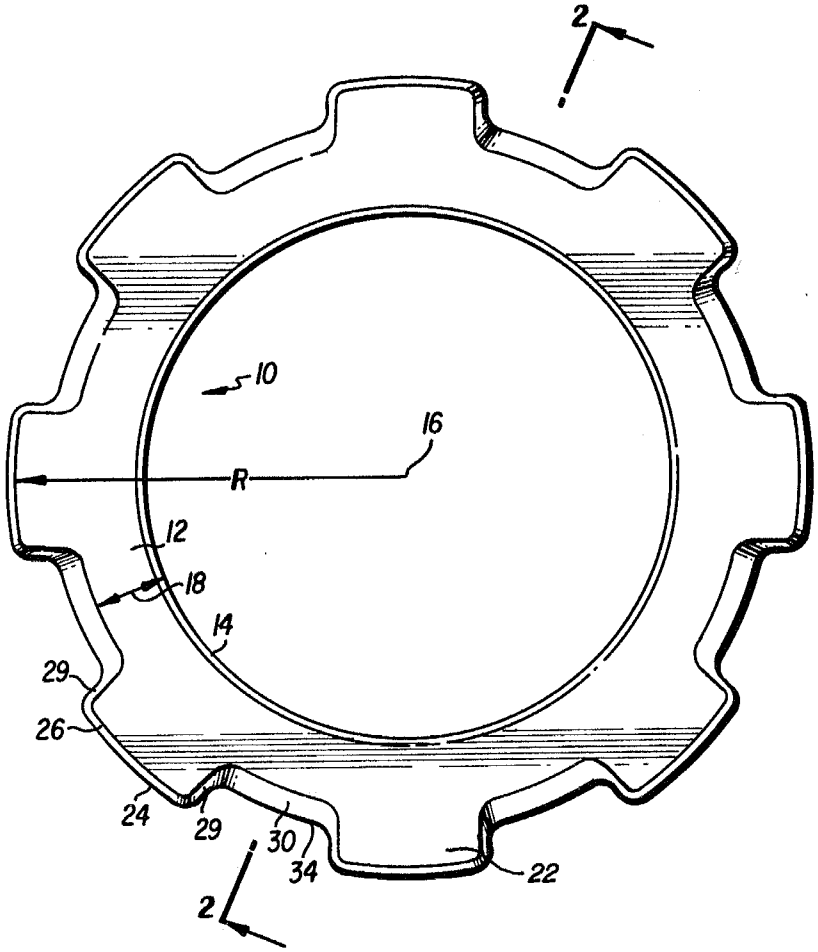
FIG. 1 shows a plan view of a ring hammer according to the present invention.

Referring to FIGS. 1 and 2, a ring hammer 10 according to the present invention is seen to comprise a substantially circular body 12 having a central bore 14 with an axis 16, a radial thickness 18 and an axial length 20. A plurality of teeth 22 project radially outwardly from circular body 12, each of the teeth having at least one contact surface 24 extending partially circumferentially around the circular body, at least at the radially outermost portion of the tooth. Contact surfaces 24 preferably are substantially parallel to axis 16 and are centered on the axial length of the circular body between a pair of tapered surfaces 26 which extend at an angle $\alpha$ from contact surfaces 24 to the end surfaces 28 of circular body 12. Angle $\alpha$ preferably is greater than zero and less than 5° to ensure that contact surface 24 and the axially extending striking surfaces or flanks 29 of the teeth 22 will be as wide as possible while still retaining sufficient taper to ensure that the hammer can be withdrawn from a forging die.

Between teeth 22 is provided a plurality of connecting segments 30 which taper at an angle $\beta$ from end surfaces 28 to define further contact surfaces 34. Angle $\beta$ is chosen to be larger than angle $\alpha$ but preferably is less than 20°. The magnitude of angle $\beta$ is chosen to optimize the size of flanks 29 and yet provide adequate strength for ring body 12. Flanks 29 extend onto contact surfaces 24 and further contact surfaces 34, so that a continuous contact surface is provided in the preferred embodiment. However, it is also within the scope of the invention to provide connecting segments which taper continuously from the axial center of the ring, so long as the taper is larger than that of tapered surfaces 26 of teeth 22.

The differential between angle $\alpha$ and angle $\beta$ is important in the present invention as can be understood from inspection of FIG. 2. As the ring hammer wears, surfaces 32, due to their larger taper, will always extend closer to the axis of the hammer than surfaces 26, even when contact surfaces 24 have worn down to the level of contact surfaces 34. This ensures that some tooth-like projections will remain on the circumference of the hammer even following extensive wear. The presence of such tooth-like projections optimizes the effectiveness of the hammer throughout its lifetime and ensures more even wear distribution.

Preferably, each tooth 22 is symmetrical about a radius R extending from axis 16, as shown in FIG. 1; however, it is also within the scope of the invention to provide a ring hammer having nonsymmetrical teeth, as shown for example in the previously mentioned prior art patents. Finally, the bore 14 of the hammer is provided with a slight taper $\gamma$ at each end to facilitate removal of the hammer from a forging die. Preferably $\gamma$ is approximately 5°.

In one actual embodiment of the invention, a 45 pound ring hammer had a maximum tooth diameter of 10½ inches, a maximum connecting segment diameter of 9½ inches, a central bore diameter of 7 inches and an axial length of 3-15/16 inches. Contact surfaces 24 and 34 were 1¼ inches wide, based on angle $\alpha$ being 3° and angle $\beta$ being 10°. The various corners of the hammer were rounded as necessary to minimize stress concentrations and also facilitate removal from a forging die. The hammer was forged from AISI 9260 steel, though of course other alloys may be used. Later heat treatment provided a surface hardness of approximately 300 to 350 BHN, though acceptable hardness at the lower end of this range is also obtainable in the as-forged condition. Cast hammers of manganese steel would be expected to have an as-cast hardness of 220 to 240 BHN, which increases considerably in some environments where hard materials are crushed.

INDUSTRIAL APPLICABILITY

The ring hammer according to the present invention is particularly suited for material reducing machines of the type used for granulating materials such as coal; however, those skilled in the art will appreciate that the ring hammers according to the invention may also be used in material reducing machines particularly intended for reducing other material such as rock, ore, metal and the like. The hammers are also particularly suited for manufacture by forging, but may be cast or even machined, as desired.

Having described out invention in sufficient detail to enable those skilled in the art to make and use it,

We claim:

1. A ring hammer for a material reducing apparatus, comprising:

a substantially circular body having a central bore with an axis, said circular body having an axial length and a radial thickness;

a plurality of teeth projecting radially outwardly from said circular body, each of said teeth having at least one contact surface extending partially circumferentially around said circular body at least at the radially outermost portion of the tooth and being substantially parallel to said axis, each of said teeth also tapering radially inwardly from said contact surface toward the axial ends of said hammer; and a plurality of connecting segments extending circumferentially between and interconnecting adjacent ones of said teeth, each of said connecting segments tapering radially inwardly toward the axial ends of said hammer, at an angle greater than the angle at which said teeth taper from said contact surface.

2. A ring hammer according to claim 1, wherein said contact surface is substantially cylindrical in configuration, having said axis as its center.

3. A ring hammer according to claim 1, wherein said contact surface is centered on said axial length.

4. A ring hammer according to claim 1, wherein said teeth are symmetric about a radius extending from said axis, when viewed axially, to facilitate reversing of said hammer in use due to wear on one side of the teeth.

5. A ring hammer according to claim 1, wherein said circular body comprises substantially planar end surfaces extending substantially perpendicular to said axis, said teeth and said connecting segments tapering to said end surfaces.

6. A ring hammer according to claim 1, wherein said connecting segments comprise further contact surfaces at the radially outermost portions thereof, said further contact surfaces extending partially around said circular body and being substantially parallel to said axis.

7. A ring hammer according to claim 6, wherein said teeth comprise axially extending flanks, said contact surfaces and said further contact surfaces merging into said flanks to form a continuous circumferentially extending surface.

8. A ring hammer according to claim 6, wherein said further contact surface is substantially cylindrical in configuration, having said axis as its center.

9. A ring hammer according to claim 6, wherein said further contact surface is centered on said axial length.

10. A ring hammer according to claim 1, wherein said contact surface tapers at an angle of up to 5° and said connecting segments taper at an angle greater than the angle of taper of said contact surface.

11. A ring hammer according to claim 1, wherein said hammer is forged.

12. A ring hammer according to claim 1, wherein said hammer is cast.

* * * * *